US010488139B1

(12) United States Patent
Graham, II et al.

(10) Patent No.: US 10,488,139 B1
(45) Date of Patent: Nov. 26, 2019

(54) METHOD AND APPARATUSES FOR ATTACHING DEVICES TO FIREARM

(71) Applicants: Henry L. Graham, II, Zirconia, NC (US); Michael Derdziak, Greenville, SC (US)

(72) Inventors: Henry L. Graham, II, Zirconia, NC (US); Michael Derdziak, Greenville, SC (US)

(73) Assignee: Rugged Design, Inc., Travelers Rest, SC (US)

( * ) Notice: Subject to any disclaimer, the term of this patent is extended or adjusted under 35 U.S.C. 154(b) by 0 days.

(21) Appl. No.: 15/907,375

(22) Filed: Feb. 28, 2018

Related U.S. Application Data

(63) Continuation-in-part of application No. 29/634,285, filed on Jan. 19, 2018, now abandoned, and a continuation-in-part of application No. 29/634,282, filed on Jan. 19, 2018, now abandoned.

(51) Int. Cl.
*F41A 21/00* (2006.01)
*F41A 21/32* (2006.01)

(52) U.S. Cl.
CPC ..... *F41A 21/325* (2013.01)

(58) Field of Classification Search
CPC ..... F41A 21/30; F41A 21/325
See application file for complete search history.

(56) References Cited

U.S. PATENT DOCUMENTS 5,698,810 A * 12/1997 Rose ..... F41A 21/32 42/97
7,117,626 B1 * 10/2006 Alzamora ..... F41A 9/65 42/108
7,661,349 B1 * 2/2010 Brittingham ..... F41A 21/30 181/223
7,789,009 B1 * 9/2010 Brittingham ..... F41A 21/325 181/223
8,490,535 B1 7/2013 Moore
8,499,676 B1 8/2013 Moore
(Continued)

OTHER PUBLICATIONS

Accurate Ordnance. <https://accurateordnance.com/signature-series-rifles-now-equipped-with-rugged-suppressor-brakes/> May 4, 2017. (Year: 2017).*

(Continued)

*Primary Examiner* — Gabriel J. Klein

(57) ABSTRACT

Methods and interface devices for attaching to a firearm muzzle a suppressor having a rearward end with a threaded portion. The interface device includes an elongated body portion having a first end portion, a second end portion generally opposite the first end portion. The body portion defines a bore therethrough, and the bore defines a longitudinally-extending central axis. The first end of the body portion defines a threaded engagement portion configured to threadingly engage the threaded portion of the firearm muzzle. The exterior surface of the body portion defines visible indicia indicating a preselected position, whereby upon the suppressor being threadingly engaged with the threaded engagement portion and rotated such that the rearward end suppressor is at a preselected position relative to the indicia, the suppressor is properly tightened with respect to the interface device.

12 Claims, 15 Drawing Sheets

(56) References Cited

U.S. PATENT DOCUMENTS

| | | | | |
|---|---|---|---|---|
| 8,997,621 | B1 | 4/2015 | Dater | |
| 9,500,427 | B1 | 11/2016 | Larue | |
| 9,513,078 | B1 * | 12/2016 | Fulton | F41A 21/30 |
| 2001/0049996 | A1 | 12/2001 | Fluhr | |
| 2006/0060076 | A1 | 3/2006 | Dueck | |
| 2010/0139145 | A1 * | 6/2010 | Brittingham | F41A 21/325 42/90 |
| 2010/0275493 | A1 | 11/2010 | Polovnev | |
| 2010/0313743 | A1 | 12/2010 | Dueck | |
| 2011/0067950 | A1 | 3/2011 | Shults | |
| 2012/0180623 | A1 | 7/2012 | Graham, II | |
| 2012/0272818 | A1 | 11/2012 | Dueck | |
| 2013/0000170 | A1 | 1/2013 | Dueck | |
| 2013/0133976 | A1 | 5/2013 | Johansen | |
| 2013/0180796 | A1 | 7/2013 | Dueck | |
| 2014/0020976 | A1 | 1/2014 | Shults | |
| 2014/0231168 | A1 | 8/2014 | Dueck | |
| 2014/0237881 | A1 * | 8/2014 | Mack | F41A 21/325 42/90 |
| 2015/0253098 | A1 | 9/2015 | Russell | |
| 2016/0102935 | A1 | 4/2016 | Young | |

OTHER PUBLICATIONS

Rugged Supressors Surge 762. <https://www.nfatracker.com/community/topic/modern-rifleman-rugged-suppressors-surge-762-review/>. Oct. 17, 2016. (Year: 2016).*

* cited by examiner

METHOD AND APPARATUSES FOR ATTACHING DEVICES TO FIREARM

BACKGROUND

This invention relates generally to methods and devices for attaching a device to the muzzle of a firearm, and, more specifically, for attaching a device such as a suppressor to an interface device, such as a flash hider, which may be integral with or detachably connected to the muzzle.

Devices are sometimes attached to the muzzle of the barrel of a firearm, and in particular, such devices could include flash hiders, suppressors, gas collection devices, etc. In applications where a flash hider is attached to the muzzle, a suppressor may then be selectively attached to the flash hider. This can be accomplished by the flash hider having threads which are threadingly engaged by corresponding threads on a suppressor, with the suppressor being turned and tightened onto the flash hider for subsequent use when firing rounds with the firearm.

However, a problem may arise if the suppressor is not tightened adequately, or overtightened, when attached to the flash suppressor.

Thus, the need arises for a method and apparatus for readily securing a suppressor to a firearm, and more specifically, to a flash hider attached to a muzzle, that facilitates the user properly securing the suppressor to the firearm.

SUMMARY

In accordance with implementation of the present disclosure, as embodied and broadly described herein, such implementations, in one aspect, relate to firearms, and more specifically to apparatuses and methods for attaching or removing a sound suppressor or other devices to a firearm. Note that suppressors and other attachment devices are referred to collectively herein as "suppressors."

The present disclosure provides a flash suppressor that includes, in certain implementations, indicia which allow the user to gage how tightly the suppressor, or other attachment device, must be twisted when threadingly attaching to the flash hider. Such indicia could take the form of printed, etched, and/or engraved lettering, wording, marks, one or more adhesive labels, or other indicia which would assist the user in sufficiently tightening, while avoiding over tightening the suppressor or other device when attaching to the muzzle of a firearm.

In one aspect, the methods and apparatuses also include implementations wherein the indicia indicates a range of acceptable pre-selected positions indicating the suppressor is at a preselected position and properly tightened with respect to the interface device.

In a further implementation, the indicia includes the word "GO," which expressly indicates a range of acceptable pre-selected positions wherein the suppressor is properly tightened with respect to the interface device, and also includes the words "NO GO" or the word "NOGO" expressly indicating a range of unacceptable pre-selected positions indicating that the suppressor is not properly tightened with respect to the interface device. In another implementation, words other than "go," "no go," or "nogo" could be used to similarly indicate acceptable ranges and unacceptable ranges of tightening of the suppressor.

In other implementations, the body portion of the interface device is configured as a flash hider, but it is to be understood that the interface device of the present disclosure is not limited to being a flash hider and could be integral with the muzzle of a firearm or separate and attachable and/or detachable therefrom.

In one implementation, the rearward end of the suppressor, once twisted to be adjacent the indicia, indicates that the suppressor is properly tightened with respect to the interface device.

In another implementation, a firearm is disclosed having a barrel with a muzzle, and including a threaded suppressor having a rearward end with a threaded portion and an interface device attached to the firearm muzzle and configured for receiving the threaded compressor. The interface device includes an elongated body portion having a first end portion and a second end portion generally opposite the first end portion. The elongated body portion further defines a bore therethrough, with such bore defining a longitudinally extending central axis. The first end of the elongated body portion defines an exterior surface, and the exterior surface defines visible indicia indicating a pre-selected position, whereby, upon the suppressor being threadingly engaged with the threaded engagement portion and rotated such that the suppressor is at a pre-selected position relative to the indicia the suppressor is properly tightened with respect to the interface device.

In a further implementation of the present disclosure, a method is described for attaching a suppressor to the barrel of a firearm, the barrel including a muzzle defining a threaded portion. The method includes the steps of providing a suppressor having a rearward end with a threaded portion and providing an interface device having an elongated body portion defining a bore therethrough and an exterior surface defining visible indicia indicating a pre-selected position. The method further includes the steps of attaching the interface device to the muzzle and threadingly engaging the threaded portion of the suppressor with the engagement portion and rotating the suppressor relative to the interface device such that the suppressor arrives at a pre-selected position relative to the indicia, whereby the suppressor is properly tightened with respect to the interface device.

In still another implementation of the method, the step of rotating the suppressor relative to the interface device includes rotating the suppressor sufficiently for the rearward end of the suppressor to be adjacent the indicia.

The features, functions, and advantages that have been discussed can be achieved independently in various examples or may be combined in yet other examples, further details of which can be seen with reference to the following description and drawings.

BRIEF DESCRIPTION OF THE DRAWINGS

Figure 1:
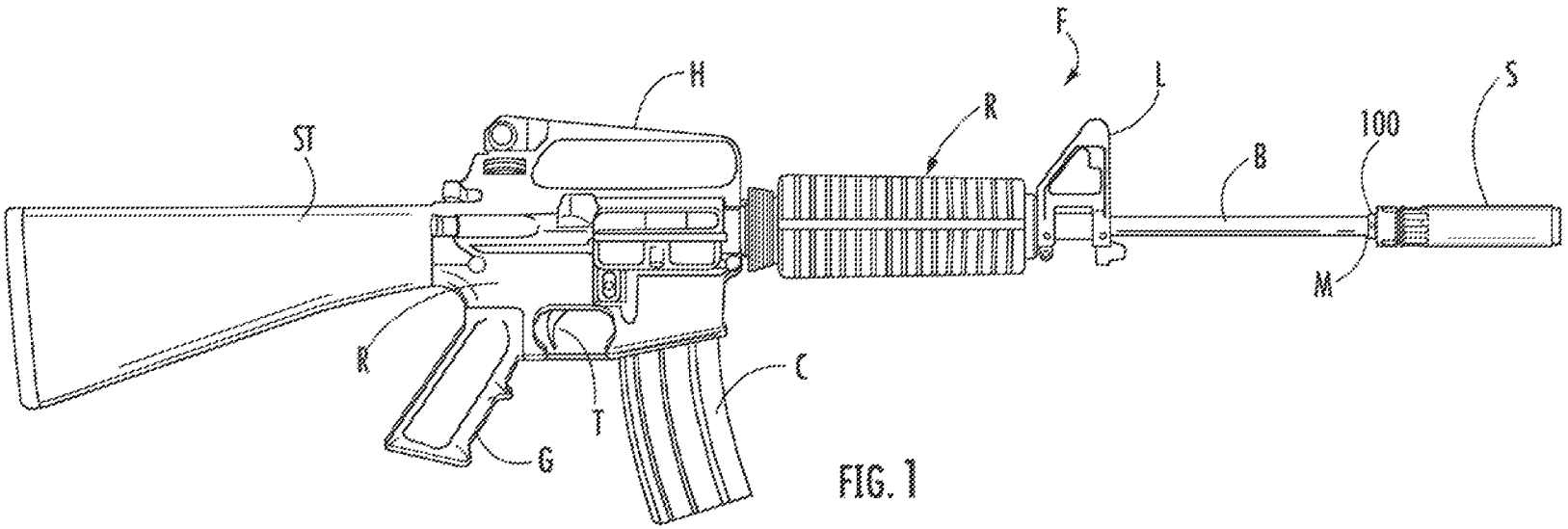
Figure 2A:
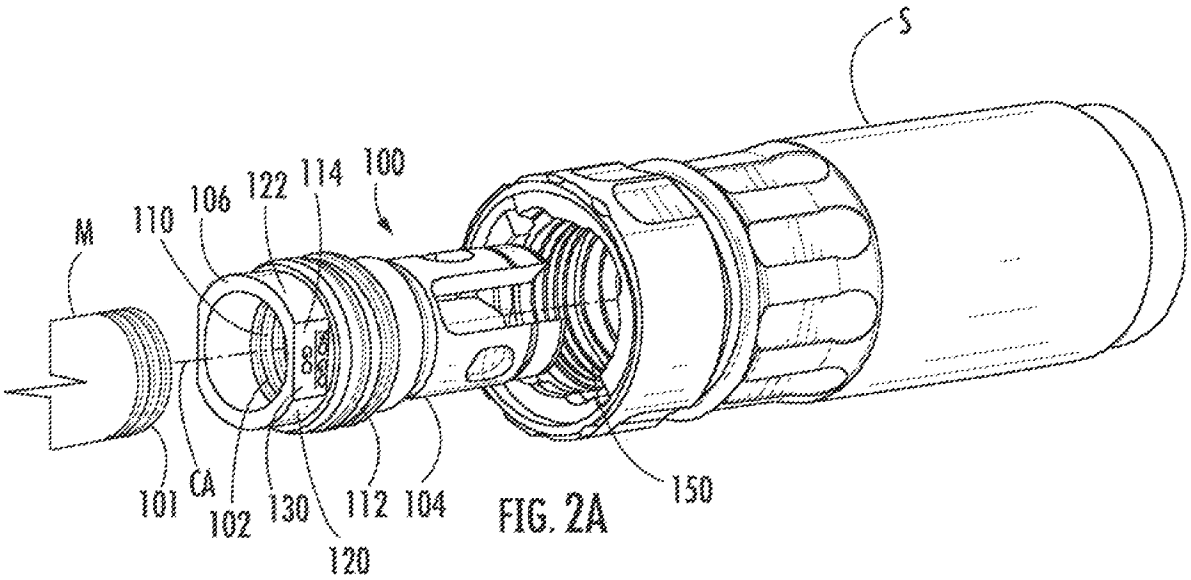
Figure 2B:
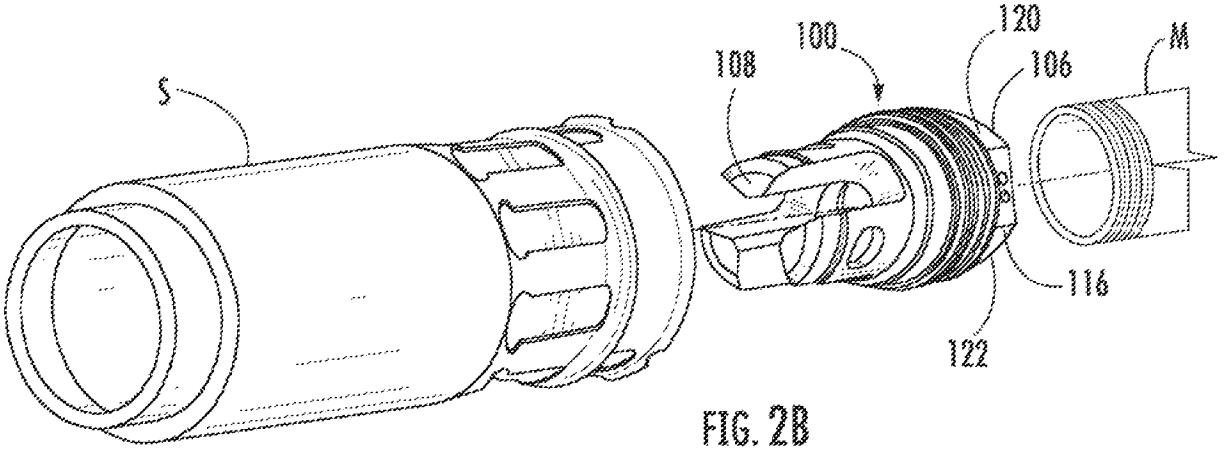
Figure 3A:
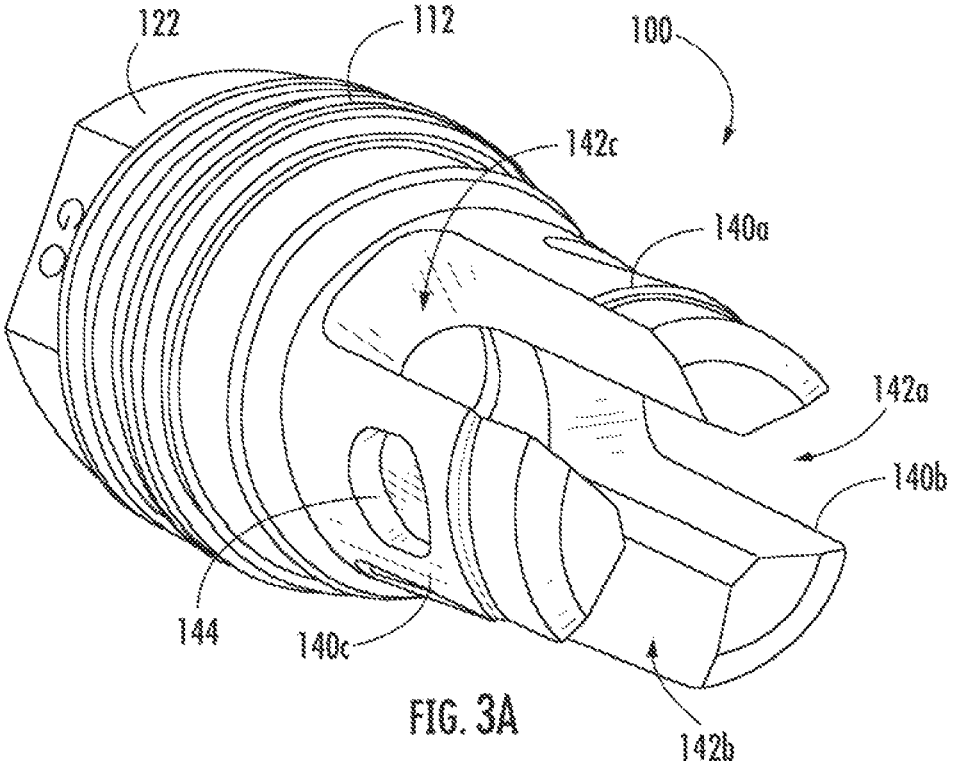
Figure 3B:
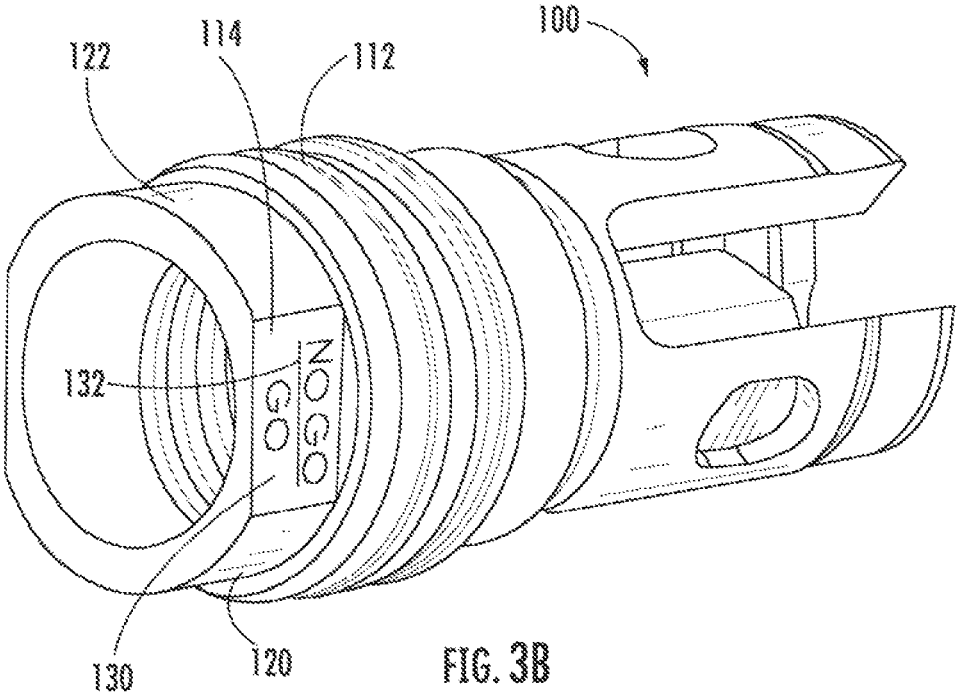
Figure 4A:
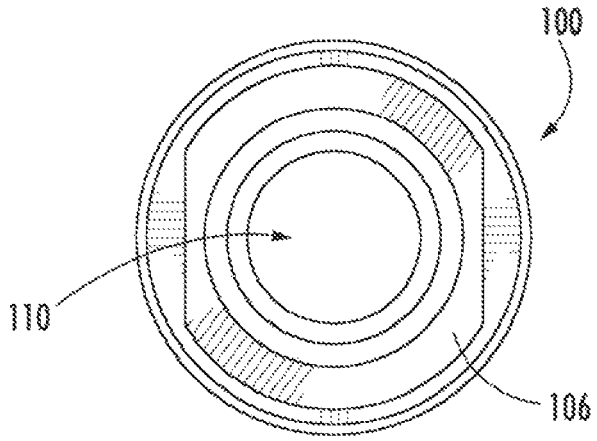
Figure 4B:
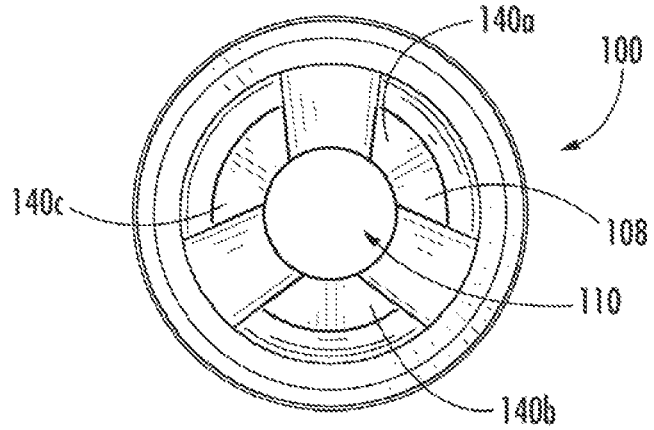
Figure 4C:
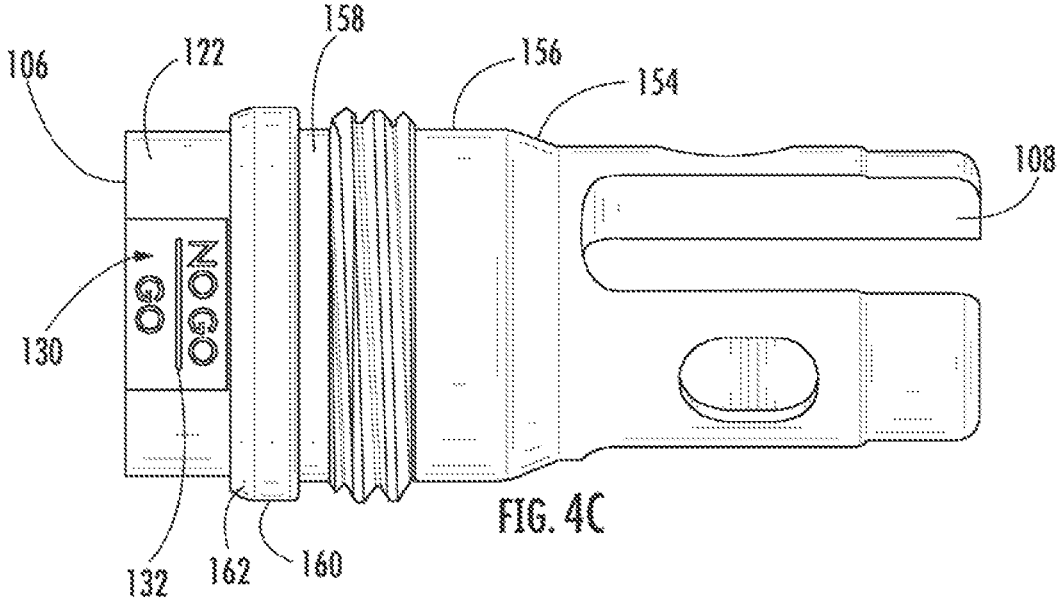
Figure 5A:
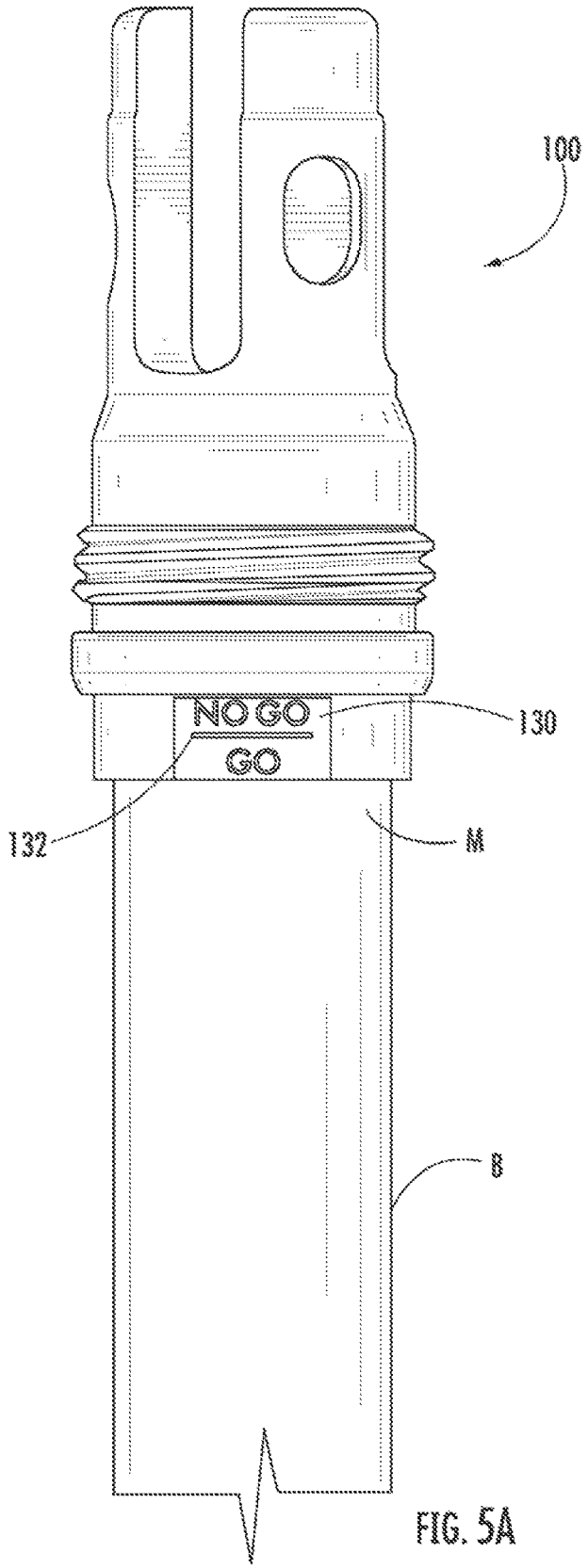
Figure 5B:
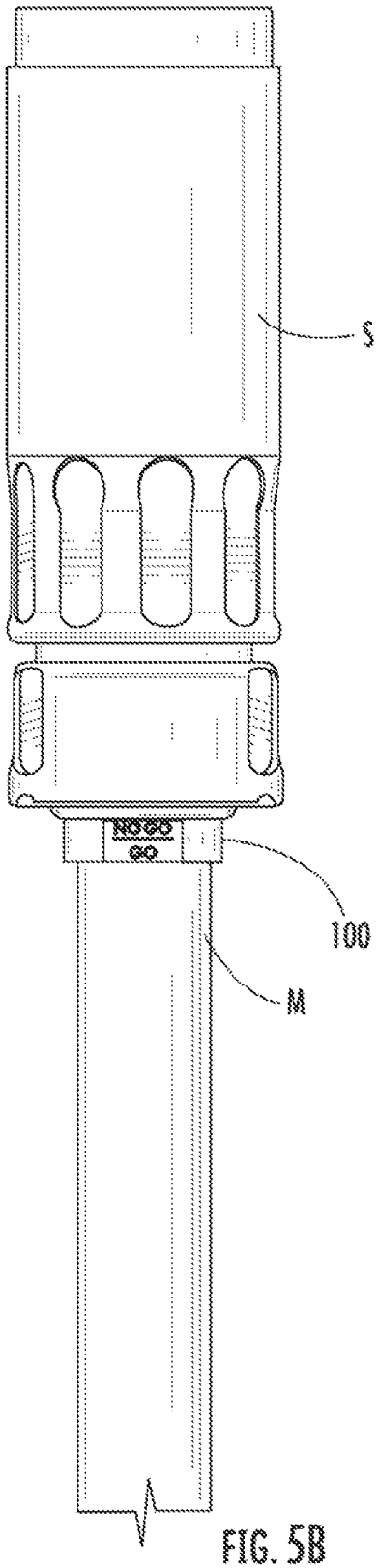
Figure 5C:
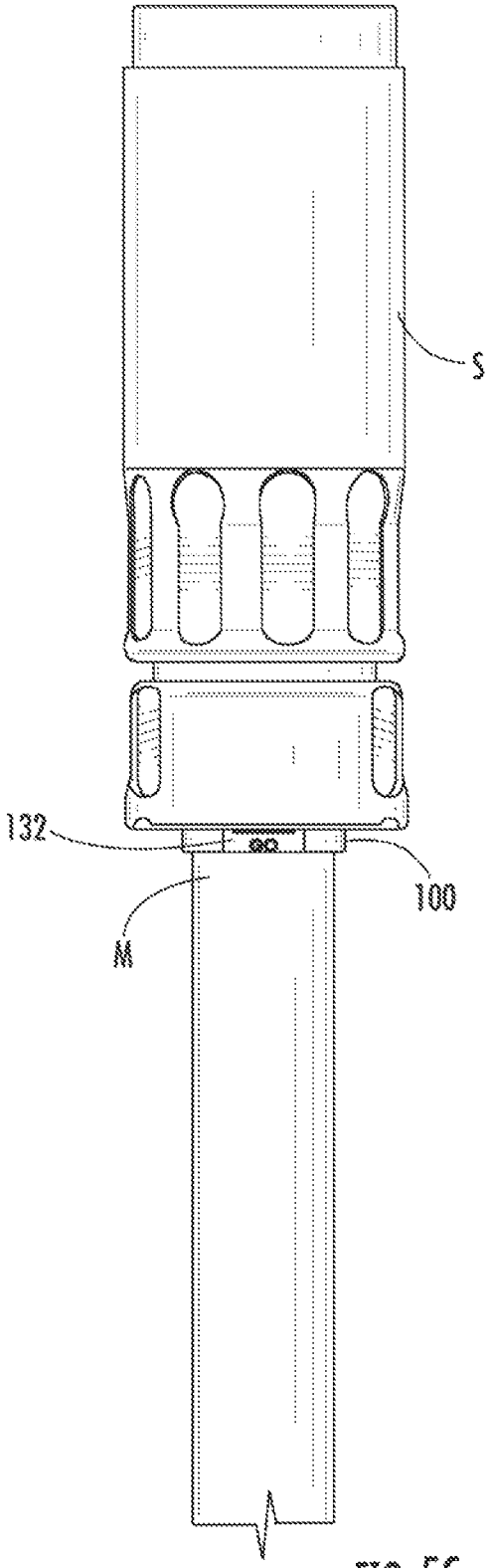
Figure 6:
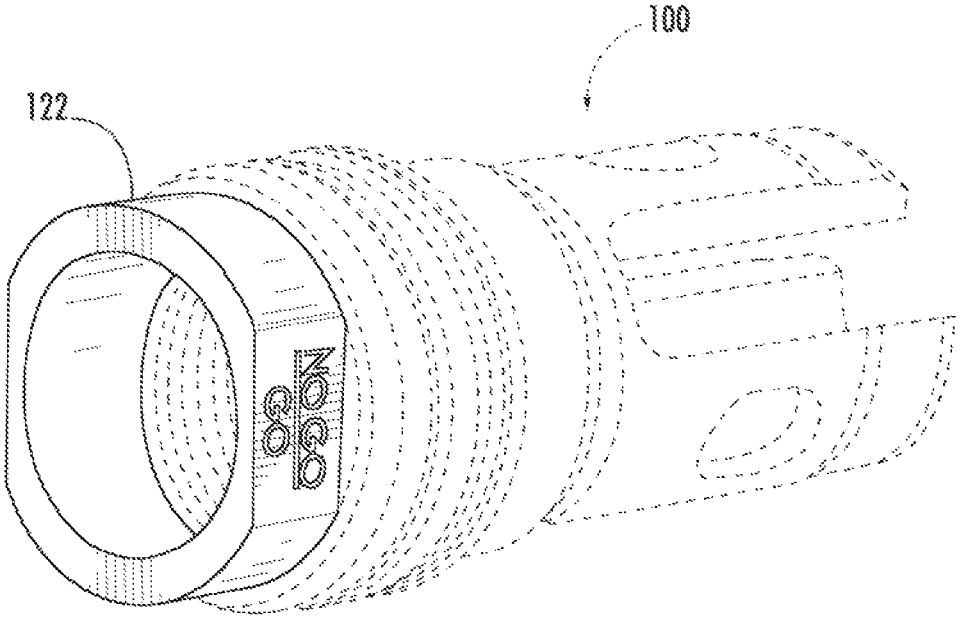
Figure 7:
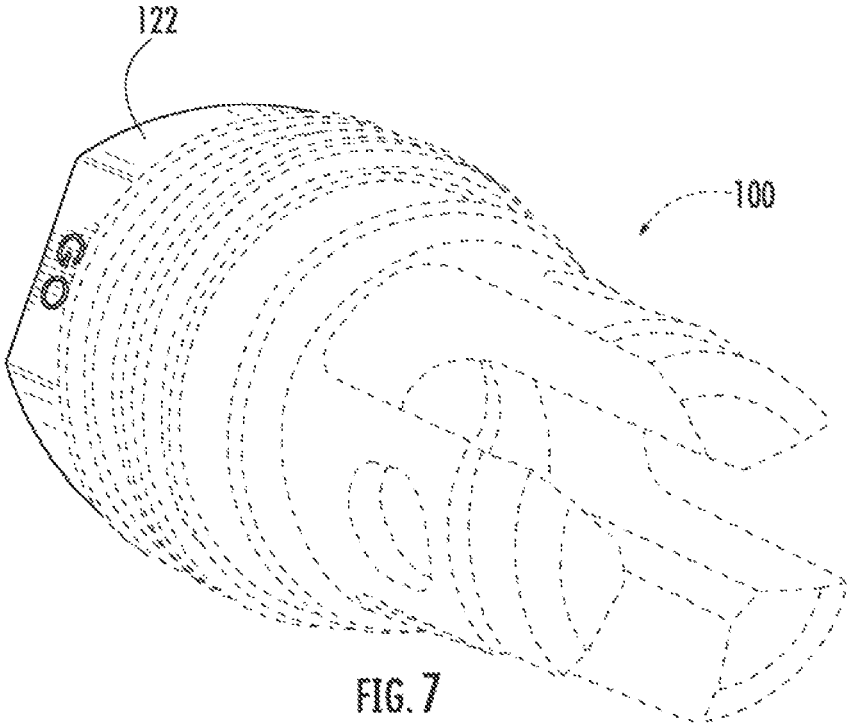
Figure 8:
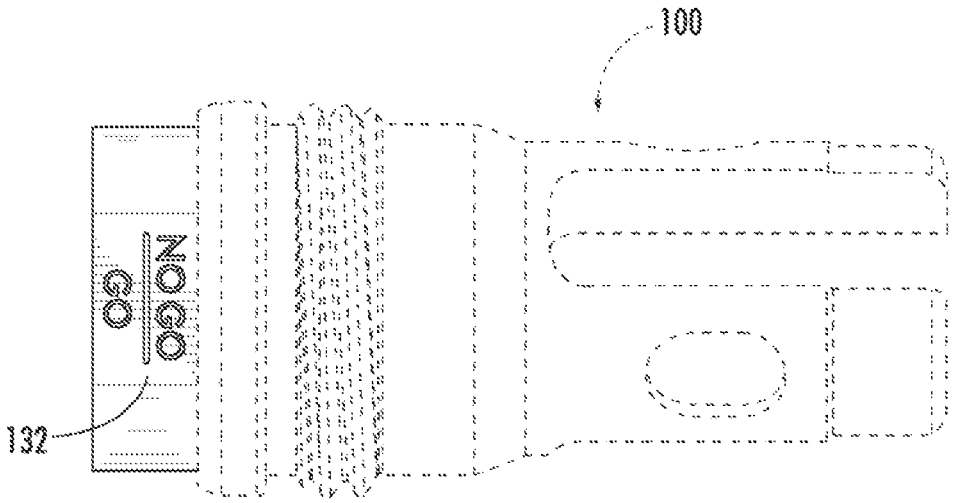
Figure 9:
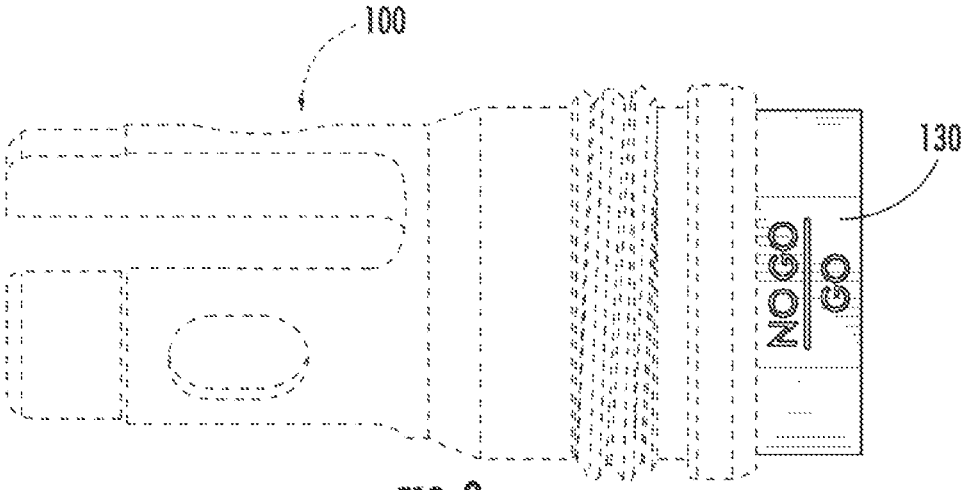
Figure 10:
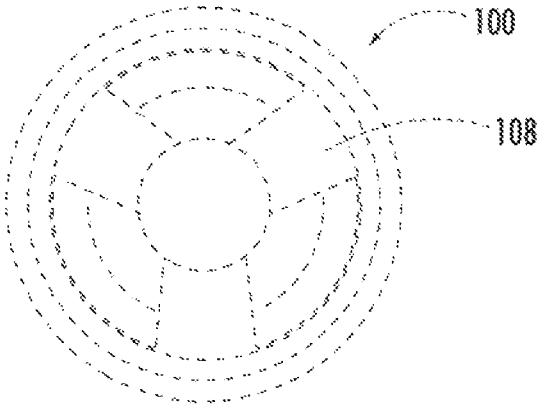
Figure 11:
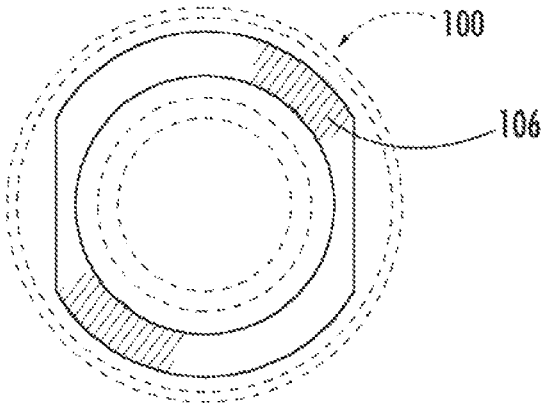
Figure 12:
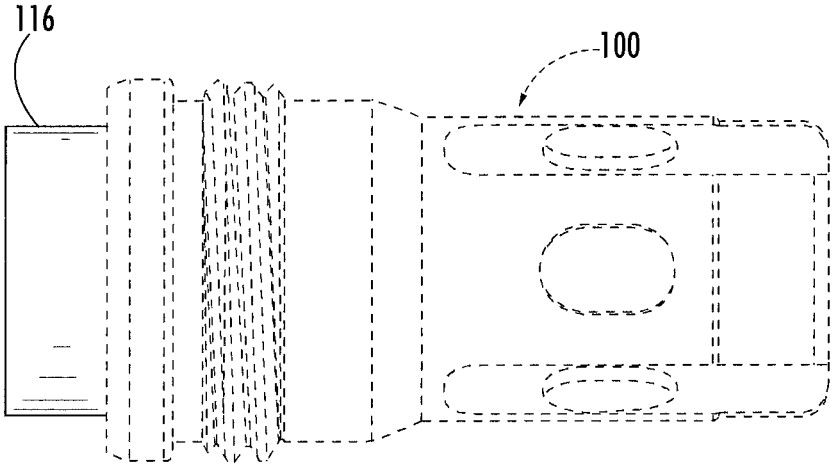
Figure 13:
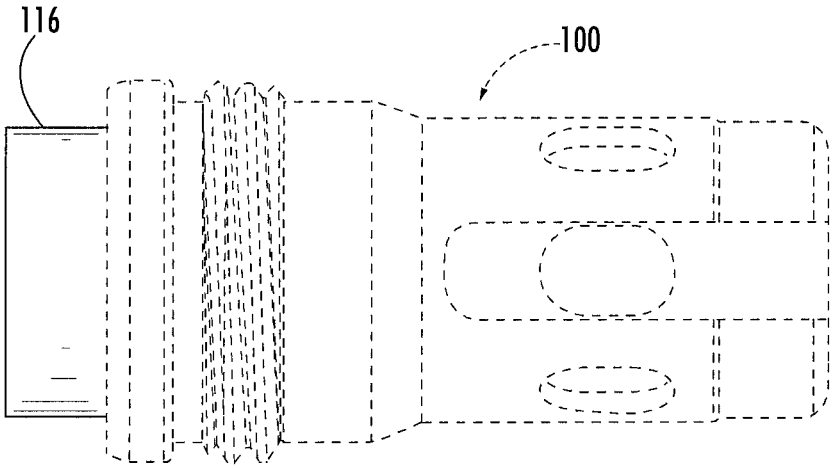
Figure 14:
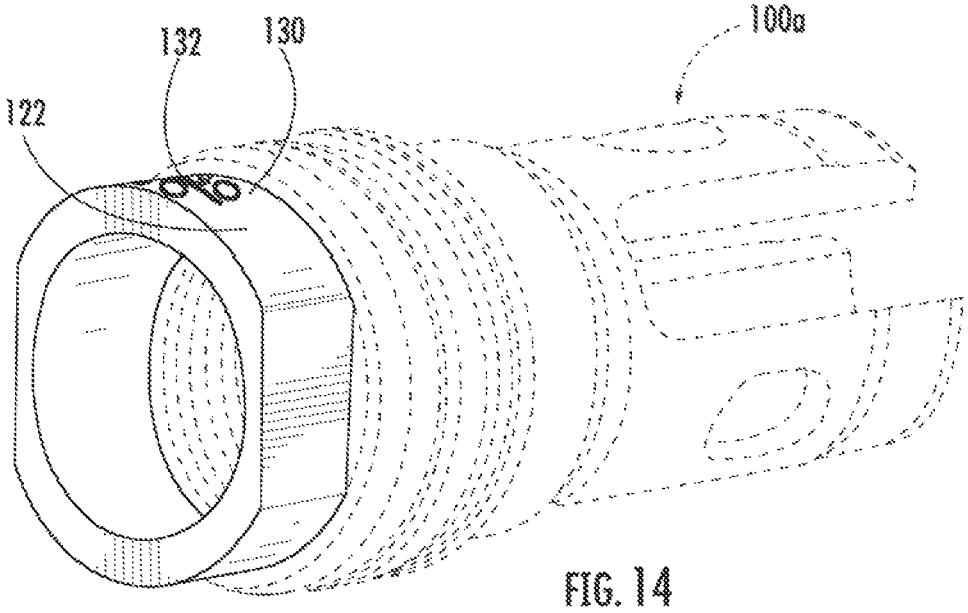
Figure 15:
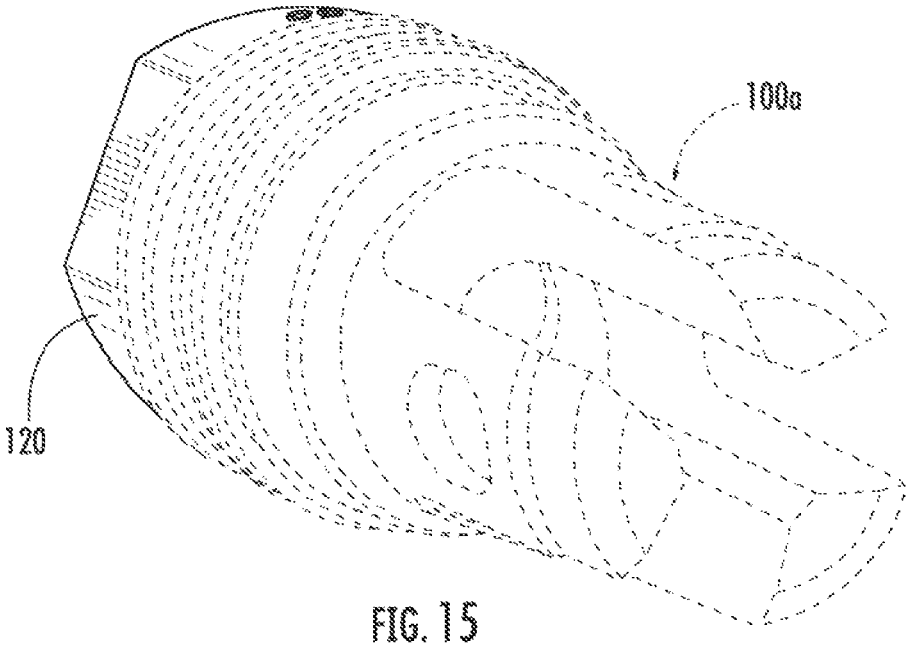
Figure 16:
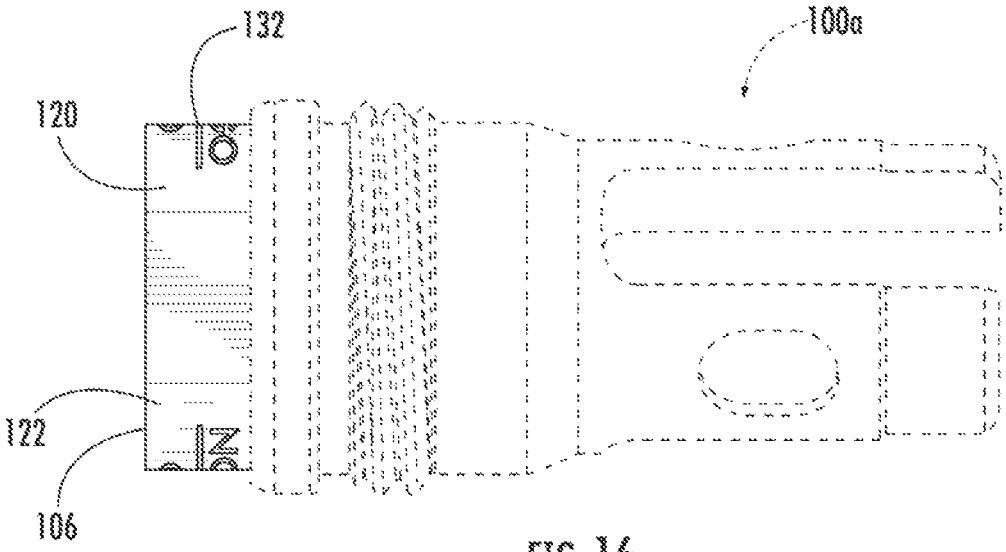
Figure 17:
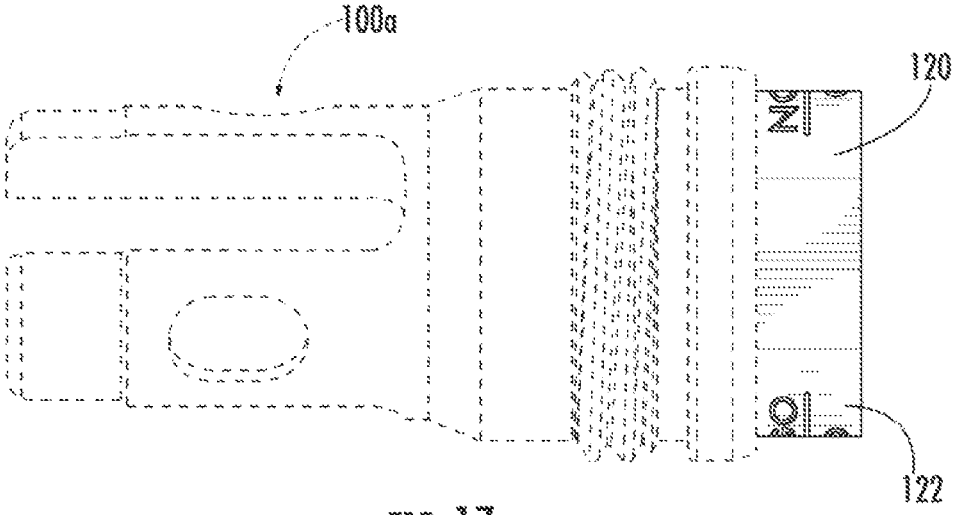
Figure 18:
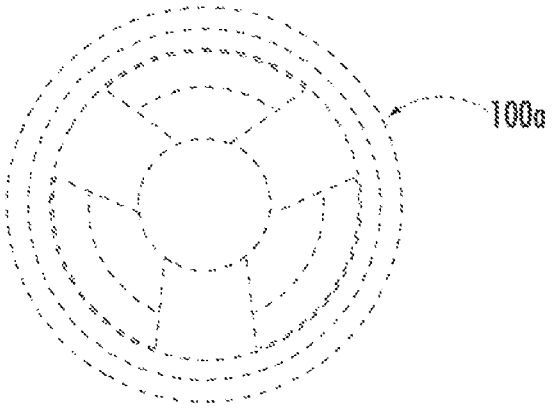
Figure 19:
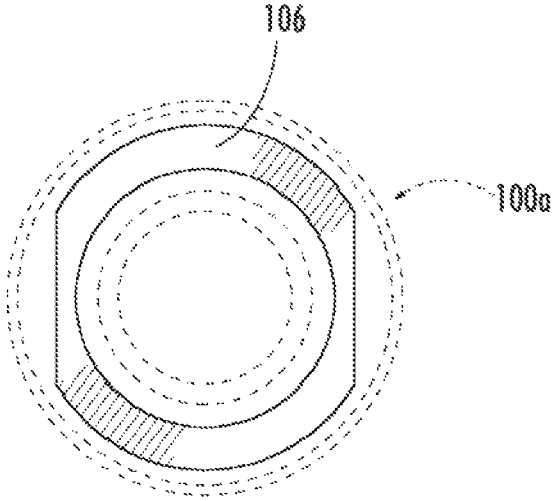
Figure 20:
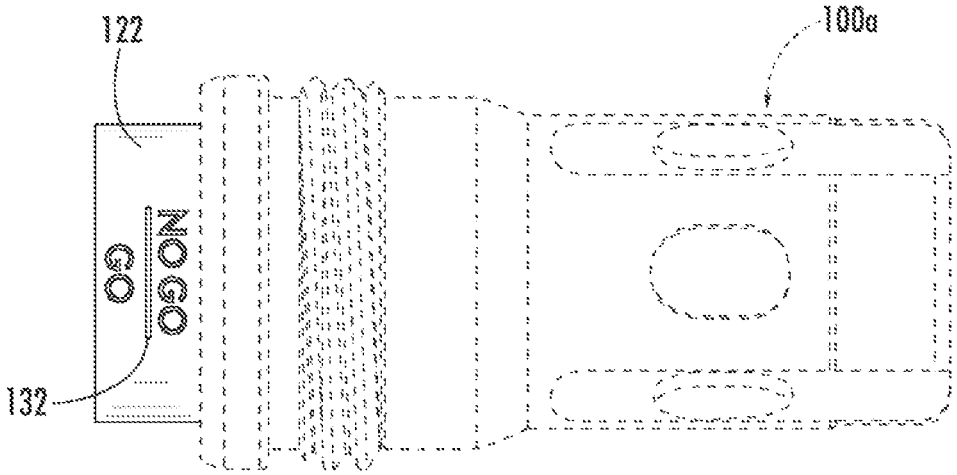
Figure 21:
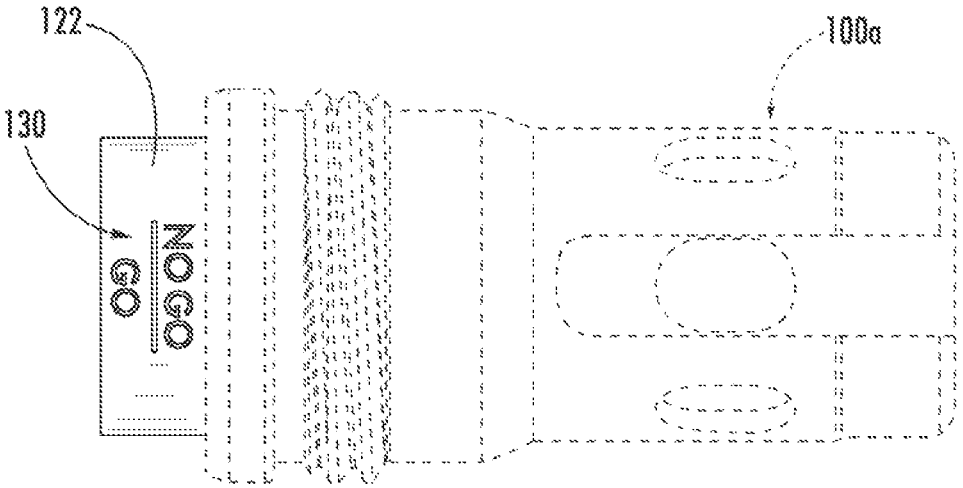

Having thus described exemplary aspects of the disclosure in general terms, various features and attendant advantages of the disclosed concepts will become more fully appreciated as the same becomes better understood when considered in conjunction with the accompanying drawings, which are not necessarily drawn to scale, in which like reference characters designate the same or similar parts throughout the several views, and wherein:

FIG. 1 is a side elevational view of a firearm, specifically a rifle, employing use of an interface device, such as a flash hider, of the present disclosure, to which a suppressor, or other muzzle attachment device, is attached;

FIG. 2A is an exploded view, from the rear of the interface device shown in FIG. 1;

FIG. 2B is an exploded view, from the front of the interface device shown in FIG. 1;

FIG. 3A is a perspective view from the front of the interface device of the present disclosure;

FIG. 3B is a perspective view from the rear of the interface device of the present disclosure;

FIG. 4A is a bottom plan view of the interface device of the present disclosure;

FIG. 4B is a top plan view of an interface device of the present disclosure;

FIG. 4C is a side elevational view of an interface device of the present disclosure;

FIG. 5A is a side elevational view of an interface device of the present disclosure shown being received in the muzzle of a firearm barrel;

FIG. 5B is a side elevational view of an interface device of the present disclosure being received in a muzzle end of a firearm barrel, with a suppressor, or other muzzle attachment device, being attached to such interface device, but not sufficiently tightened to the interface device to obscure the "NOGO" indicia on the interface device;

FIG. 5C is a side elevational view of an interface device of the present disclosure being received in a muzzle end of a firearm barrel, with a suppressor, or other muzzle attachment, being attached to such interface device, but sufficiently tightened to the interface device such that the "NOGO" indicia is obscured;

FIG. 6 is a perspective front view of an alternative implementation showing an interface device in accordance with the present disclosure;

FIG. 7 is a perspective rear view of the interface device shown in FIG. 6;

FIG. 8 is a right-side elevational view of the interface device shown in FIG. 6;

FIG. 9 is a left-side elevational view of the interface device shown in FIG. 6;

FIG. 10 is a rear elevational view of the interface device shown in FIG. 6;

FIG. 11 is a front elevational view of the interface device shown in FIG. 6;

FIG. 12 is a top plan view of the interface device shown in FIG. 6;

FIG. 13 is a bottom plan view of the interface device shown in FIG. 6;

FIG. 14 is a perspective front view of an alternate implementation of a interface device in accordance with the present disclosure;

FIG. 15 is a perspective rear view of an alternate implementation of the interface device shown in FIG. 14;

FIG. 16 is a right-side elevational view of an alternate implementation of the interface device shown in FIG. 14;

FIG. 17 is a left-side elevational view of an alternate implementation of the interface device shown in FIG. 14;

FIG. 18 is a rear elevational view of an alternate implementation of the interface device shown in FIG. 14;

FIG. 19 is a front elevational view of an alternate implementation of the interface device shown in FIG. 14;

FIG. 20 is a top plan view of an alternate implementation of the interface device shown in FIG. 14; and FIG. 21 is a bottom plan view of an alternate implementation of the interface device shown in FIG. 14.

DETAILED DESCRIPTION

Examples of the present disclosure will now be described more fully hereinafter with reference to the accompanying drawings, in which some, but not all examples of the disclosure are shown. Indeed, various exemplary aspects of the disclosure may be embodied in many different forms and should not be construed as limited to the examples set forth herein. Rather, these examples are provided so that this disclosure will be thorough and complete and will fully convey the scope of the disclosure to those skilled in the art. Like reference numerals refer to like elements throughout.

It is to be understood that as used herein, use of articles "a," and, "the," etc. are understood to include multiples, unless the context expressly dictates to the contrary. Accordingly, as an example, "an attachment" can include multiple attachments.

Furthermore, it is understood that as used herein, words describing a range of values expressed as an approximation by use of a modifier "about" will be understood as including the particular expressed values and that the end points of such range are independent of one another, meaning one end point could include the modifier "about", while the other end point is not so-modified.

Also, as used herein, the terms "optional," or "optionally," mean that the so described event or condition may or may not occur and that the present disclosure includes instances where such event or condition occurs or does not occur.

Additionally, as used herein, the teens "forward," "forwardly," and "front", refer to the firing direction of the firearm and/or suppressor as shown in the figures, while "rearward," "rear," "rearwardly," and "behind" mean the direction opposite from the firing direction.

Referring, now to FIG. 1, a firearm, generally, F, and more specifically as shown in FIG. 1, a rifle, generally R, is illustrated having a barrel B, a stock ST, a trigger T, a receiver R, a grip G, a clip C, a handle H, a bayonet lug L, a muzzle, or muzzle portion, generally M, i.e., the extreme end portion of the barrel B, a suppressor S, and an implementation of an interface device, generally 100, as discussed above and in further detail herein.

The interface device 100 could be a flash hider as shown in the drawings or some other configuration (none shown) and may be integral with or selectively attached (in a detachable or non-detachable manner, as desired) to muzzle M. Suppressor S is in turn threadingly attached to interface device 100. Positioning of the suppressor S on the interface device 100 in the proper manner is of concern, in that the suppressor S should not be overtightened, as overtightening could damage the suppressor S and/or impact its functionality, nor should the suppressor S be under tightened, which could again damage the suppressor S and/or impede its optimal functioning. In either case, i.e., whether overtightened or under tightened, improper tightening of the suppressor S to the interface device 100 could pose a grave safety risk to the operator and/or those who may be nearby upon firing of the firearm F.

FIGS. 2A and 2B illustrate the interface device 100 prior to being attached to the muzzle M. In this implementation, the muzzle M includes external threads 101 which are received by internal threads 102 of interface device 100. Interface device 100 includes an elongated body portion, generally 104, having a first end portion, or end, 106, and a second end portion, generally 108, opposite the first end portion 106. Elongated body portion 104 defines a bore 110 therethrough and the bore 110 defines a longitudinally extending central axis CA. The exterior portion of the first end 106 of the elongated body portion 104 includes one or more planar, surfaces, or flats, 114 defined on collar 116 at the extreme rearward end 106 of elongated body portion 104. Extending between the flats 114 of collar 116 are generally cylindrical exterior portions 120 and 122. Defined on the implementation of interface device 100 shown in FIGS. 2A, 2B, 3A, 3B, 4C, and 5A-5C is visible indicia, generally 130, on one or more flats 114 indicating preselected positions, namely the words "NO GO," and positioned forward of the word "GO," with a line 132 extending between the words "NO GO" and "GO," such line 132 being generally perpendicular to the central axis CA. Body portion 104 includes three forward extending prongs 140*a*, 140*b*, 140*c* which define slots 142*a*, 142*b*, 142*a* therebetween. Each prong may optionally include a recess 144.

As shown in the foregoing referenced figures, the implementation of interface device 100 is such that it operates as a flash hider and performs such function even if a suppressor S is not attached thereto. It is to be understood, however, that it is not necessary for interface device 100 to be configured as a flash hider to still perform its role as described herein as facilitating the proper tightening of a suppressor to the muzzle.

FIGS. 3A and 3B show interface device 100 isolated from the firearm F and the suppressor S. Note the internal threads 102 and external threads 12 of the interface device 100 in FIG. 3B. Internal threads 102 threadingly engage with external threads 101 of muzzle M, and external threads 150 of interface device 100 engaged by the internal threads 150 of the suppressor shown in FIG. 2A.

FIGS. 4A and 4B illustrate first, or rearward, end 106 and second, or forward, end 108 views of interface device 100, respectively, and a side view is shown in FIG. 4C. As also shown in FIG. 4C, extending rearwardly from prongs 140*a*, 140*b*, 140*c*, is a tapered shoulder 154, a generally cylindrical portion 156 spanning between shoulder 154 and external threads 112, another generally cylindrical portion 158 extending between external threads 112 and a circumferentially extending ridge 160. Adjacent to ridge 160 is a circumferentially extending chamfer portion 162, which terminates generally into the collar 116.

FIGS. 5A, 5B, and 5C illustrate the sequence of a method by which suppressor S is properly tightened with respect to interface device 100, and thus to muzzle M of firearm F. Beginning with FIG. 5A, interface device 100 is shown attached to muzzle M. Note the indicia 130 "NOGO" and "GO" as well as the dividing line 132 therebetween is readily visible. FIG. 5B illustrates the initial threading engagement of the suppressor S with the interface device 100, via the threading engagement of the external threads 112 of interface device 100 and the internal threads 150 of suppressor S. Again, both the "NO GO" and "GO" words are visible, as well as the dividing line 132 in between. As shown in FIG. 5C, however, upon continued rotation of the suppressor S, the rearward end 106 of the suppressor S covers the words "NO GO" and becomes adjacent dividing line DL. The only word exposed at this point is the word "GO," which indicates that the suppressor is at a preselected position relative to such indicia 130 and is thus properly tightened with respect to interface device 100.

FIGS. 6 through 13 are further illustrations of interface device 100 with the collar 164, flats, cylindrical exterior portions, and indicia being shown.

An alternate implementation, generally 100*a*, of collar 116, indicia 130, cylindrical exterior portions 120, 122, and flats 114 are shown in FIGS. 14-21. In this alternate implementation, the indicia, shown in this implementation as including the words "NO GO" and "GO" together with dividing line 132 therebetween, are shown on one or both of the cylindrical exterior portions 120, 122 instead of the flats 114. It is to be understood that such indicia could be provided on the planner portions and/or the cylindrical exterior portions if desired.

It is also to be understood that variations, such as hashed lines (not shown), symbols (not shown), and wording other than "NO GO," "NOGO," and/or "GO" could be used without departing from the scope of the present disclosure and that such initiative likewise be used to allow the user to visibly detect when the suppressor is properly tightened on the interface device.

Although specific features of various examples of the invention may be shown in some drawings and not in others, this is for convenience only. In accordance with the principles of the invention, any feature of a drawing may be referenced and/or claimed in combination with any feature of any other drawing.

This written description uses examples to disclose various examples, which include the best mode, to enable any person skilled in the art to practice those examples, including making and using any devices or systems and perfolining any incorporated methods. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An interface device configured for attachment to a firearm muzzle, the firearm muzzle having an extreme end defining a threaded portion, the interface device being configured for receiving a suppressor having a rearward end with a threaded portion, the interface device comprising:

an elongated body portion having a first end portion and a second end portion generally opposite the first end portion;

the elongated body portion defining a bore therethrough, and the bore defining a longitudinally-extending central axis;

the first end of the elongated body portion defining a first threaded engagement portion configured to threadingly engage the threaded portion of the firearm muzzle;

the elongated body portion defining a second threaded engagement portion configured to threadingly receive the suppressor;

the first end of the elongated body portion defining an exterior surface;

the exterior surface defining a visible line indicating a preselected position, whereby upon the suppressor being threadingly engaged with the second threaded engagement portion and rotated such that the rearward end of the suppressor is at the line, the suppressor is properly tightened with respect to the interface device;

the exterior surface defining the words "no go" or "nogo" positioned adjacent the line, in a direction towards the extreme end of the firearm muzzle, indicating that if the rearward end of the suppressor is at the words "no go" or "nogo", the suppressor is not properly tightened with respect to the interface device; and the exterior surface defining the word "go" positioned adjacent the line, in a direction away from the extreme end of the firearm muzzle, indicating that if the rearward end of the suppressor is at the line or at the word "go", the suppressor is properly tightened with respect to the interface device.

2. The interface device of claim 1, further comprising:

the first end of the elongated body portion having a generally cylindrical exterior portion and at least one generally planar portion; and wherein the line, the words "no go" or "nogo" and the word "go" are located on the generally planar portion.

3. The interface device of claim 1, further comprising:

the first end of the elongated body portion having a generally cylindrical exterior portion and at least one generally planar portion; and wherein the line, the words "no go" or "nogo" and the word "go" are located on the generally cylindrical exterior portion.

4. The interface device of claim 1, wherein the body portion is configured as a flash hider.

5. A firearm having a barrel with a muzzle having an extreme end, the firearm comprising:

a threaded suppressor having a rearward end with a threaded portion;

an interface device attached to the firearm muzzle and configured for receiving the threaded suppressor;

the interface device including:

an elongated body portion having a first end portion and a second end portion generally opposite the first end portion;

the elongated body portion defining a bore therethrough, and the bore defining a longitudinally extending central axis;

the elongated body portion defining a threaded engagement portion configured to threadingly receive the suppressor;

the first end of the elongated body portion defining an exterior surface;

the exterior surface defining a visible line indicating a preselected position, whereby upon the suppressor being threadingly engaged with the threaded engagement portion and rotated such that the rearward end of the suppressor is at the line, the suppressor is properly tightened with respect to the interface device;

the exterior surface defining the words "no go" or "nogo" positioned adjacent the line, in a direction towards the extreme end of the muzzle, indicating that if the rearward end of the suppressor is at the words "no go" or "nogo", the suppressor is not properly tightened with respect to the interface device; and the exterior surface defining the word "go" positioned adjacent the line, in a direction away from the extreme end of the muzzle, indicating that if the rearward end of the suppressor is at the line or at the word "go", the suppressor is properly tightened with respect to the interface device.

6. The firearm of claim 5, further comprising:

the first end of the elongated body portion having a generally cylindrical exterior portion and at least one generally flat exterior portion; and wherein the line, the words "no go" or "nogo" and the word "go" are located on the generally flat exterior portion.

7. The firearm of claim 5, further comprising:

the first end of the elongated body portion having a generally cylindrical exterior portion and at least one generally flat exterior portion; and wherein the line, the words "no go" or "nogo" and the word "go" are located on the generally cylindrical exterior portion.

8. The firearm of claim 5, wherein the body portion is configured as a flash hider.

9. A method of tightening a suppressor to the barrel of a firearm, the barrel including a muzzle defining a threaded portion and having an extreme end, the method comprising:

providing a suppressor having a rearward end with a threaded portion;

providing an interface device having an elongated body portion defining a bore therethrough, a threaded engagement portion, and an exterior surface; the exterior surface defining a visible line indicating a preselected position, whereby upon the suppressor being threadingly engaged with the threaded engagement portion and rotated such that the rearward end of the suppressor is at the line, the suppressor is properly tightened with respect to the interface device; the exterior surface defining the words "no go" or "nogo" positioned adjacent the line, in a direction towards the extreme end of the muzzle, indicating that if the rearward end of the suppressor is at the words "no go" or "nogo", the suppressor is not properly tightened with respect to the interface device; and the exterior surface defining the word "go" positioned adjacent the line, in a direction away from the extreme end of the muzzle, indicating that if the rearward end of the suppressor is at the line or at the word "go", the suppressor is properly tightened with respect to the interface device;

attaching the interface device to the muzzle;

threadingly engaging the threaded portion of the suppressor with the threaded engagement portion of the elongated body portion; and rotating the suppressor relative to the interface device such that the rearward end of the suppressor arrives at a position at the line or at the word "go", whereby the suppressor is properly tightened with respect to the interface device.

10. The method of claim 9, further comprising the rearward end of the elongated body portion having a generally cylindrical exterior portion and at least one generally flat exterior portion; and wherein the line, the words "no go" or "nogo" and the word "go" are located on the generally flat exterior portion.

11. The method of claim 9, further comprising the rearward end of the elongated body portion having a generally cylindrical exterior portion and at least one generally flat exterior portion; and wherein the line, the words "no go" or "nogo" and the word "go" are located on the generally cylindrical exterior portion.

12. The method of claim 9, wherein the body portion is configured as a flash hider.

* * * * *